US012140403B2

(12) United States Patent
Zimmer

(10) Patent No.: US 12,140,403 B2
(45) Date of Patent: Nov. 12, 2024

(54) OPTICAL SIGHT MOUNT WITH AN INTEGRATED AIMING AND ILLUMINATION MODULE

(71) Applicant: Trent Zimmer, Youngsville, LA (US)

(72) Inventor: Trent Zimmer, Youngsville, LA (US)

( * ) Notice: Subject to any disclaimer, the term of this patent is extended or adjusted under 35 U.S.C. 154(b) by 0 days.

(21) Appl. No.: 18/090,703

(22) Filed: Dec. 29, 2022

(65) Prior Publication Data

US 2023/0213311 A1 Jul. 6, 2023

Related U.S. Application Data

(60) Provisional application No. 63/295,333, filed on Dec. 30, 2021.

(51) Int. Cl.
*F41G 1/35* (2006.01)
*F41G 1/36* (2006.01)
*F41G 11/00* (2006.01)

(52) U.S. Cl.
CPC ..... *F41G 1/35* (2013.01); *F41G 1/36* (2013.01); *F41G 11/003* (2013.01)

(58) Field of Classification Search
CPC ... F41G 1/32; F41G 1/34; F41G 1/345; F41G 1/35; F41G 1/36
USPC ..... 42/114
See application file for complete search history.

(56) References Cited

U.S. PATENT DOCUMENTS 5,671,561 A * 9/1997 Johnson ..... F41G 1/35 42/114
6,338,219 B1 1/2002 Watson, Jr. et al.
6,874,269 B2 * 4/2005 Chen ..... F41G 11/003 42/106
7,367,152 B2 5/2008 Samson
7,730,655 B2 6/2010 Spuhr
7,908,782 B1 3/2011 LaRue
8,141,290 B2 * 3/2012 LaFrance ..... F41H 5/12 42/72
8,424,234 B2 4/2013 Carlson
8,510,983 B2 8/2013 Larue
8,567,981 B2 * 10/2013 Finnegan ..... F41G 1/35 42/117
8,578,647 B2 11/2013 Storch et al.
8,769,859 B2 7/2014 Li et al.
9,316,460 B2 * 4/2016 Cheng ..... F41G 1/345
10,704,862 B2 7/2020 Chung
10,782,100 B2 9/2020 Bigby et al.
11,105,590 B2 8/2021 Bigby et al.
(Continued)

*Primary Examiner* — John Cooper

(74) *Attorney, Agent, or Firm* — Asgaard Patent Services, LLC; F. Wayne Thompson, Jr.

(57) ABSTRACT

Disclosed is an optical sight mount with an integrated aiming and illumination module. The optical sight mount is configured to position an optical sighting device (e.g., a reflex sight) on a firearm so that the optical sighting device can be used to aim the firearm at a target. The aiming and illumination module, also referred to as an optical module, includes an aiming laser and an illumination source. An example optical sight mount comprises a base configured for attachment to a firearm, a mounting interface configured so that an optical sighting device can be attached thereto, and an optical module configured to emit a type of aiming radiation and illumination radiation. The optical module is positioned between the base and the mounting interface of the optical sight mount.

6 Claims, 5 Drawing Sheets

(56) References Cited

U.S. PATENT DOCUMENTS

| | | | | |
|---|---|---|---|---|
| 2008/0092421 | A1 | 4/2008 | Beckmann | |
| 2010/0229448 | A1* | 9/2010 | Houde-Walter | F41G 1/35 42/114 |
| 2011/0162251 | A1* | 7/2011 | Houde-Walter | F41G 1/35 42/146 |
| 2011/0296732 | A1 | 12/2011 | Carlson et al. | |
| 2013/0160345 | A1 | 6/2013 | Li et al. | |
| 2014/0137457 | A1 | 5/2014 | Collin et al. | |
| 2014/0259853 | A1* | 9/2014 | Crispin | G02B 23/14 42/124 |
| 2016/0033232 | A1* | 2/2016 | Cheng | F41G 1/345 42/114 |
| 2020/0025522 | A1 | 1/2020 | Zimmer | |

* cited by examiner

OPTICAL SIGHT MOUNT WITH AN INTEGRATED AIMING AND ILLUMINATION MODULE

CROSS-REFERENCE TO RELATED APPLICATION(S)

This application claims the benefit of U.S. Provisional Application Ser. No. 63/295,333, filed on Dec. 30, 2021, the entirety of which is incorporated herein by reference.

TECHNICAL FIELD

This disclosure generally relates to optical sight mounts, and more particularly, optical sight mounts with an integrated aiming and illumination module.

BACKGROUND

Optical sighting devices, such as reflex sights and holographic sights, enable the user of small arms such as handguns, rifles, and shotguns to aim these weapons. While some optical sighting devices include an integrated mount, many rely on a separate mount that is used to position the optical sighting device on a firearm.

Weapon-mounted aiming and illumination devices allow the user to rapidly acquire, identify, and engage targets. These devices are generally configured to allow for both aiming and illumination during both daytime and nighttime scenarios. As such, these devices often emit illumination and aiming laser radiation that is detectable in both the visible and infrared spectrums. These devices may also be used to visually communicate with allies over a distance.

Optical sighting devices (e.g., a reflex sight) are routinely used in conjunction with weapon-mounted aiming and illumination devices (e.g., a laser aiming module such as the Steiner Optics DBAL-A3). However, optimal positioning of both devices on a host firearm can be difficult due to limited available mounting space and the positioning of other use case specific gear (e.g., night-vision devices, thermal imagers, etc.) on the host firearm.

As such, it would be advantageous to integrate an aiming and illumination device into a mount for an optical sighting device. Accordingly, needs exist for the optical sight mount disclosed herein. It is to the provision of an optical sight mount configured to address these needs, and others, that the present invention is primarily directed.

SUMMARY OF THE INVENTION

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is an optical sight mount with an integrated aiming and illumination module. The optical sight mount is configured to position an optical sighting device (e.g., a reflex sight, such as an Aimpoint® CompM5) on a firearm so that the optical sighting device can be used to aim the firearm at a target. The aiming and illumination module, also referred to as an optical module, includes an aiming laser and an illumination source.

An example optical sight mount comprises a base configured for attachment to a firearm, a mounting interface configured so that an optical sighting device can be attached thereto, and an optical module comprising an aiming laser configured to emit a type of aiming radiation and an illumination source configured to emit a type of illumination radiation. The optical module is positioned underneath the mounting interface, between a front end and a back end of the base.

Another example optical sight mount comprises a base configured for attachment to a firearm, a mounting interface configured so that an optical sighting device can be attached thereto, and an optical module comprising an aiming laser configured to emit a type of aiming radiation and an illumination source configured to emit a type of illumination radiation. The aiming laser and the illumination source of the optical module are positioned within a longitudinally extending opening located underneath the mounting interface, between a front end and a back end of the base.

Yet another example optical sight mount comprises a base configured for attachment to a firearm, a mounting interface configured so that an optical sighting device can be attached thereto, and an optical module comprising an aiming laser configured to emit a type of aiming radiation and an illumination source configured to emit a type of illumination radiation. The aiming laser and illumination source of the optical module are positioned within a longitudinally extending opening located underneath the mounting interface, between a front end and a back end of the base. A front end of the optical module is recessed from an exit opening of the longitudinally extending opening.

BRIEF DESCRIPTION OF THE DRAWINGS

Like reference numerals refer to corresponding parts throughout the several views of the drawings.

DETAILED DESCRIPTION

Figure 1:
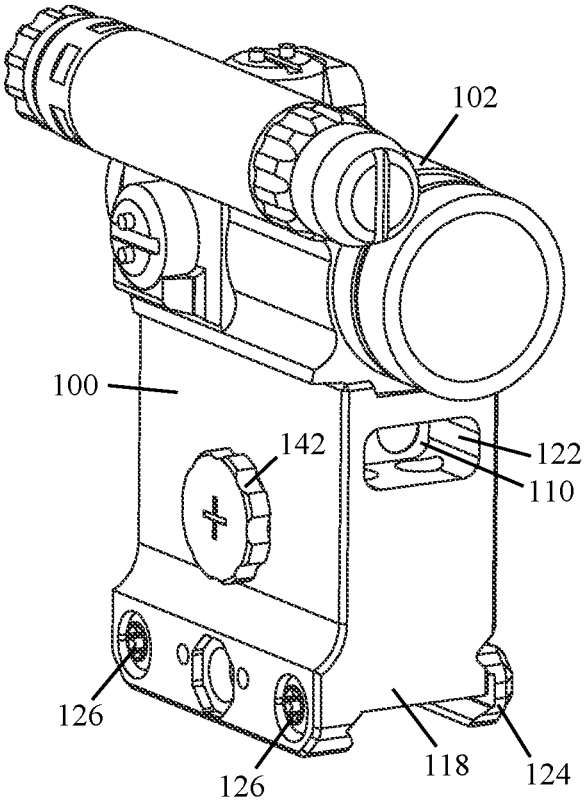
FIG. 1 is an isometric view of an example optical sight mount with an integrated aiming and illumination module. An optical sighting device is attached to the mounting interface of the optical sight mount.
Figure 2:
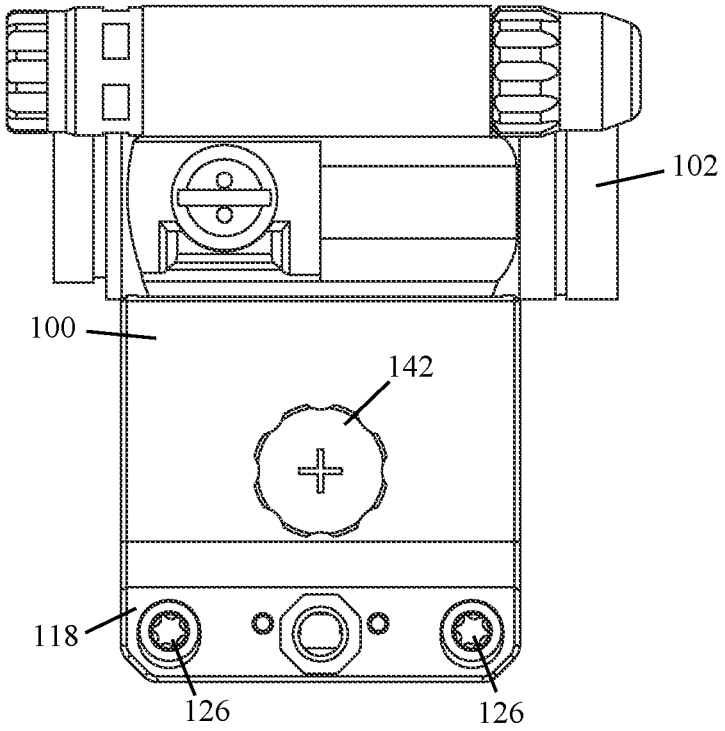
FIG. 2 is a right side elevational view of the optical sight mount with the integrated aiming and illumination module shown in FIG. 1.

FIGS. 1-6 illustrate an example optical sight mount with an integrated aiming and illumination module 100 according to the principles of the present disclosure. The optical sight mount 100 is configured to position an optical sighting device 102 (e.g., a reflex sight, such as an Aimpoint®

CompM5) on a firearm (e.g., a rifle) so that the optical sighting device 102 can be used to aim the firearm at a target. The integrated aiming an illumination module 110, also referred to as an optical module, includes an aiming laser 114 and an illumination source 116. In the preferred embodiment, the aiming laser 114 and illumination source 116 each emit infrared radiation (IR) visible to night-vision devices. However, in some implementations, the aiming laser 114 and illumination source 116 may be configured to emit visible radiation instead of IR radiation.

As shown in FIGS. 1-6, the optical sight mount 100 comprises a base 118 that can be mounted to an accessory rail (e.g., a Picatinny rail system, or other alternative rail systems); a mounting interface 120 configured so that an optical sighting device 102 can be attached thereto; and the integrated aiming and illumination module 110 embedded within a longitudinally extending opening 122 positioned between the base 118 and the mounting interface 120.

The base 118 of the optical sight mount 100 comprises a moveable clamp member 124 that can be moved into and out of engagement with an accessory rail by a pair of bolts 126. In this way, the optical sight mount 100 can be mounted to an accessory rail. The clamp member 124 is connected to the base 118 by the two bolts 114, each of which is threaded at its end to permit adjustment of the distance between the receiving groove 128 of the base 118 and the receiving groove 130 of the clamp member 124. The receiving groove 128 of the base 118 and the receiving groove 130 of the clamp member 124 are configured to receive opposing portions of an accessory rail therein.

The clamping mechanism used to secure the base 118 of an optical sight mount 100 to an accessory rail is not critical to the design of the present invention. Therefore, the base 118 is configured to work with another clamping mechanism, known to those of ordinary skill in the art, capable of releasably mounting the optical sight mount 100 to an accessory rail (i.e., an embodiment of the locking release clamp assembly disclosed in U.S. Pat. No. 8,578,647 to Troy Storch et al.).

Figure 6:
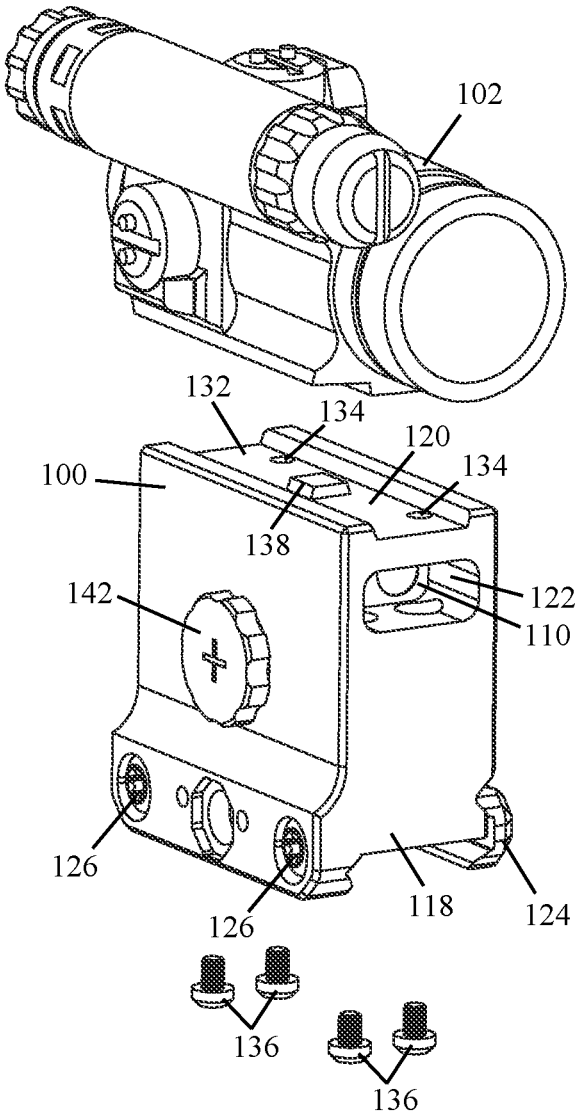
FIG. 6 is an exploded isometric view of the optical sight mount with the integrated aiming and illumination module shown in FIG. 1. The optical sighting device and fasteners are shown exploded from the optical sight mount.

As shown best in FIG. 6, the mounting interface 120 of the optical sight mount 100 includes a recess 132 configured to receive at least a portion of an optical sighting device 102 therein (e.g., an Aimpoint® CompM5). However, it should be understood that the mounting interface 120 can be configured (e.g., dimensioned) to interface with the mount compatible surface (i.e., the bottom side) of other optical sighting devices. The mounting interface 120 also includes four openings 134 that extend therethrough. In this way, fasteners 136 (e.g., screws) may be used to secure the optical sighting device 102 to the mounting interface 120 of the optical sight mount 100. In some implementations, the mounting interface 120 includes at least one recoil lug 138. The recoil lug 138 is a projection extending from the recess 132 of the mounting interface 120 that is configured to fit into a receptacle in the underside of the optical sighting device 102. In this way, the attached optical sighting device 102 is prevented from sliding back-and-forth due to incidental vibrations associated with the discharge of a firearm. In some implementations, the mounting interface 120 does not include a recoil lug 138.

In some implementations, the optical sight mount 100 is configured to position the optical sighting device 102 so that the centerline thereof is ~2.26" above the top of the mounting interface the optical sight mount 100 is attached to. In some implementations, the optical sight mount 100 may be configured to position the optical sighting device 102 so that the centerline thereof is less than, or greater than, 2.26" above the top of the mounting interface the optical sight mount 100 is attached to (not shown).

Figure 5:
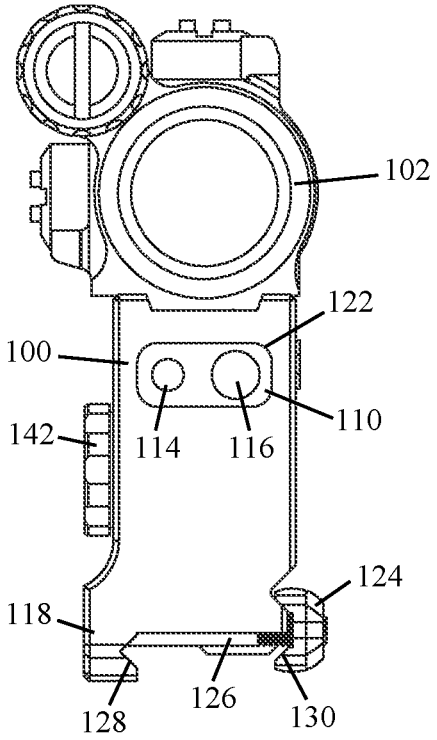
FIG. 5 is a front side elevational view of the optical sight mount with the integrated aiming and illumination module shown in FIG. 1.

As shown in FIG. 5, the aiming laser 114 and illumination source 116 of the optical module 110 are positioned side-by-side within the longitudinally extending opening 122 of the optical sight mount 100. However, in some implementations, the aiming laser 114 and illumination source 116 may not be positioned side-by-side. In some implementations, the optical axis of the aiming laser 114 and/or the illumination source 116 is adjustable for perfecting a desired alignment with the discharge axis of the firearm on which the optical sight mount 100 is attached. The aiming laser 114 and the illumination source 116 may each comprise an array of VCSEL sources having fixed illumination power and divergences. The VCSEL sources of each optical device may be configured to be used in combination to achieve desired radiation output. In some implementations, other radiation sources may be used, for example, LEDs, solid-state laser sources, etc. One of ordinary skill in the art having the benefit of the present disclosure would be able to select appropriate radiation sources.

The optical sight mount 100 holds an electrical power source, (e.g., a battery 140) in a battery compartment 142 enclosed by a removable cap, and the power supply circuitry (not shown) needed to operate the optical module 110 and other electrical components described herein.

Figure 3:
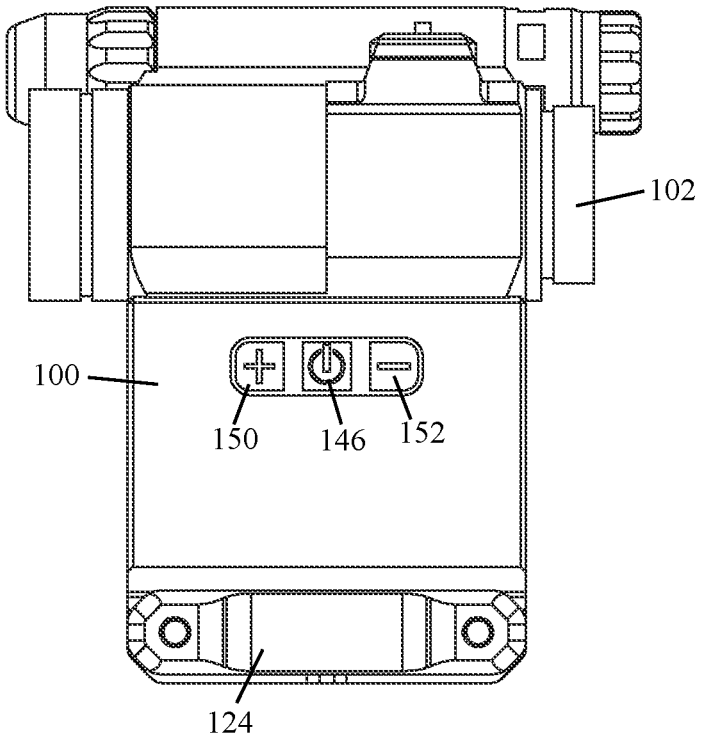
FIG. 3 is a left side elevational view of the optical sight mount with the integrated aiming and illumination module shown in FIG. 1.
Figure 4:
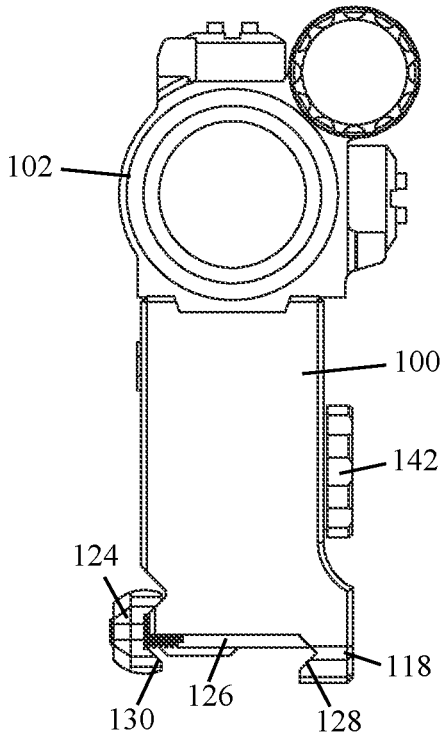
FIG. 4 is a back side elevational view of the optical sight mount with the integrated aiming and illumination module shown in FIG. 1.
Figure 7:
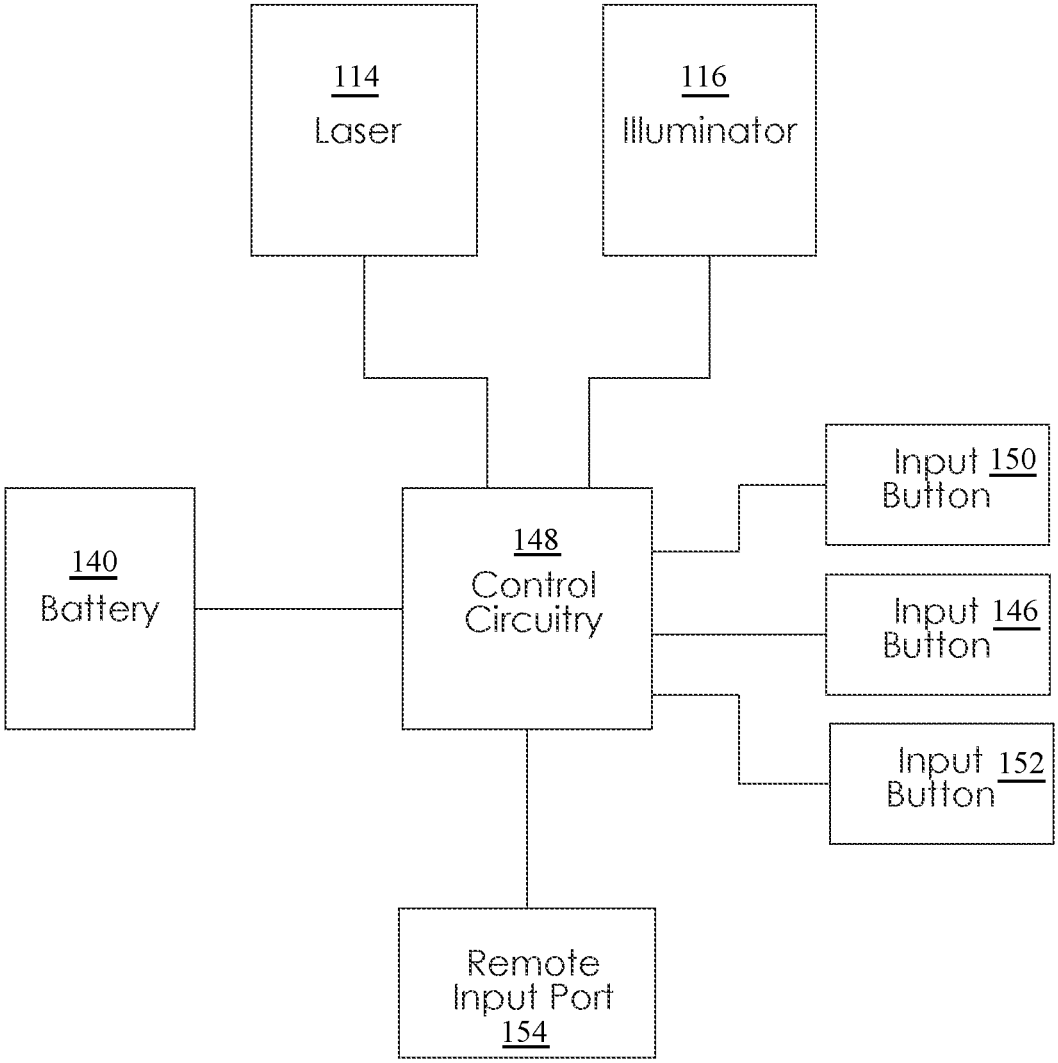
FIG. 7 is a schematic view of electrical components found in some implementations of the optical sight mount with the integrated aiming and illumination module.

As show in FIGS. 3 and 7, the optical sight mount 100 includes a power switch 144 used for electrically connecting and disconnecting the aiming laser 114 and illumination source 116 of the optical module 110 to the battery 140. The power switch 146, in conjunction with appropriately configured control circuitry 148, may be configured to act as a device selection switch, thereby allowing a user to selectively power the aiming laser 114 and/or the illumination source 116. Adjacent the power switch 144 is a first adjustment switch 150 and a second adjustment switch 152 used to increase and decrease, respectively, the radiation output of the aiming laser 114 and/or illumination source 116 of the optical module 110.

As shown in FIG. 7, an optical sight mount 100 may include a remote fire switch port 154 used to connect the optical module 110 to a remote switch. The remote fire switch port 154 is configured so that user can activate the aiming laser 114 and/or illumination source 116 of the optical module 110 using a connected remote switch (not shown). An example remote switch, also referred to as a control device, is the Hot Button, sold by Unity Tactical, LLC. An example control device includes a pushbutton switch and a flexible cable having a connector or plug.

Although not shown, in some implementations, the optical module 110 may be removable from the longitudinally extending opening 122 in the optical sight mount 100. In this way, for example, a damaged or outdated optical module 110 can be replaced. Further, the optical module 110 may be configured for use with other optical sight mounts having a suitably configured receptacle for the optical module 110.

In some implementations, an optical module 110 may be equipped with a thermal imager and/or a video camera instead of the aiming laser 114 and/or illumination source 116. Implementations of the optical module 110 that include a thermal imager and/or a video camera are configured to record and to store the recording.

Although not shown in the drawings, it will be understood that suitable wiring, traces, or a combination thereof, connect the electrical components of the optical sight mount 100 disclosed herein (e.g., the aiming laser 114 and illumination source 116 of the optical module 110, the battery 140, the power switch 146, the first adjustment switch 150, and the second adjustment switch 152).

Excluding the electrical components, moveable clamp member 124, bolts 126, and fasteners 136, the example optical sight mount 100 shown in FIGS. 1-6 may be fabricated from an aluminum alloy, or another material that is suitably light weight and impact resistant.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. An optical sight mount comprising:

a base configured for attachment to a firearm, the base comprising a front end and a back end;

a mounting interface configured so that an optical sighting device can be attached thereto; and an optical module comprising an aiming laser configured to emit a type of aiming radiation and an illumination source configured to emit a type of illumination radiation;

wherein:

the optical module is positioned underneath the mounting interface, between the front end and the back end of the base.

2. The optical sight mount of claim 1, wherein the type of aiming radiation or illumination radiation comprises one of visible radiation or infrared radiation.

3. An optical sight mount comprising:

a base configured for attachment to a firearm, the base comprising a front end and a back end;

a mounting interface configured so that an optical sighting device can be attached thereto; and an optical module comprising an aiming laser configured to emit a type of aiming radiation and an illumination source configured to emit a type of illumination radiation;

wherein:

the aiming laser and illumination source of the optical module are positioned within a longitudinally extending opening located underneath the mounting interface, between the front end and the back end of the base.

4. The optical sight mount of claim 3, wherein the type of aiming radiation or illumination radiation comprises one of visible radiation or infrared radiation.

5. An optical sight mount comprising:

a base configured for attachment to an accessory rail, the base comprising a front end and a back end;

a mounting interface configured so that an optical sighting device can be attached thereto; and an optical module comprising an aiming laser configured to emit a type of aiming radiation and an illumination source configured to emit a type of illumination radiation;

wherein:

the aiming laser and illumination source of the optical module are positioned within a longitudinally extending opening located underneath the mounting interface, between the front end and the back end of the base; and a front end of the optical module is recessed from an exit opening of the longitudinally extending opening.

6. The optical sight mount of claim 5, wherein the type of aiming radiation or illumination radiation comprises one of visible radiation or infrared radiation.

* * * * *